United States Patent [19]

Shulman

[11] 4,109,445

[45] Aug. 29, 1978

[54] OVERHEAD LOAD-WRAPPING APPARATUS

[76] Inventor: Michael H. Shulman, 45 Bruce Farm Drive, Willowdale, Ontario, Canada

[21] Appl. No.: 819,130

[22] Filed: Jul. 26, 1977

[51] Int. Cl.[2] ..... B65B 13/04

[52] U.S. Cl. ..... 53/198 R; 53/210

[58] Field of Search ..... 53/30 S, 32, 184 S, 53/139.3, 198 R, 210; 100/27, 28; 242/2, 3

[56] References Cited

U.S. PATENT DOCUMENTS

| | | | |
|---|---|---|---|
| 2,972,843 | 2/1961 | Du Broh | 53/198 R X |
| 3,003,297 | 10/1961 | Broadhead et al. | 53/198 R |
| 3,239,994 | 3/1966 | Etzel et al. | 53/198 R |
| 3,793,798 | 2/1974 | Lancaster et al. | 53/184 S X |
| 3,857,486 | 12/1974 | Kleranoff, Jr. | 53/32 X |
| 3,910,005 | 10/1975 | Thimon | 53/210 X |
| 3,928,939 | 12/1975 | Edwards | 53/32 |

FOREIGN PATENT DOCUMENTS

| | | | |
|---|---|---|---|
| 2,303,590 | 8/1973 | Fed. Rep. of Germany | 53/210 |

*Primary Examiner*—John Sipos
*Attorney, Agent, or Firm*—Sim & McBurney

[57] ABSTRACT

There is provided an apparatus for wrapping a film around a palletized load, in which the main operative portions are suspended above the load, in order to save space. A central driven shaft extends downwardly from a frame which is supported above the wrapping location, and the shaft supports and rotates a radially extending arm from the distal end of which a downward member extends. A vertically reciprocating carriage mounted on the downward member carries a roll of film, which is dispensed as the roll is carried in a circular path to orbit around the load. Where the width of the film is less than the height of the load, the carriage is reciprocated while orbiting, so that a helical wrapping procedure can be accomplished. A similar but non-reciprocating carriage permits the wrapping to be performed using a film width equal to the height of the load as an alternative embodiment.

5 Claims, 3 Drawing Figures

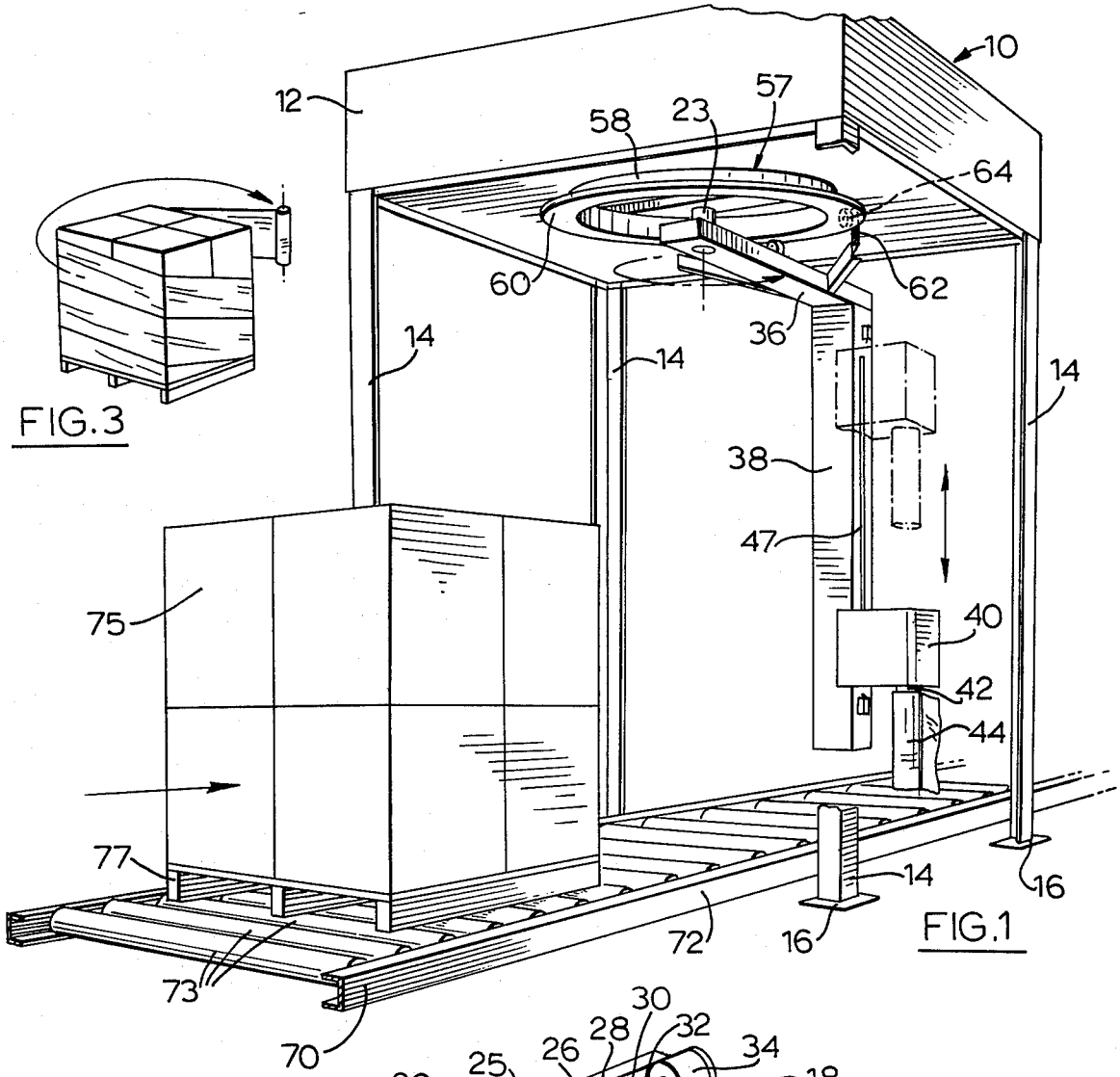
FIG.3
FIG.1
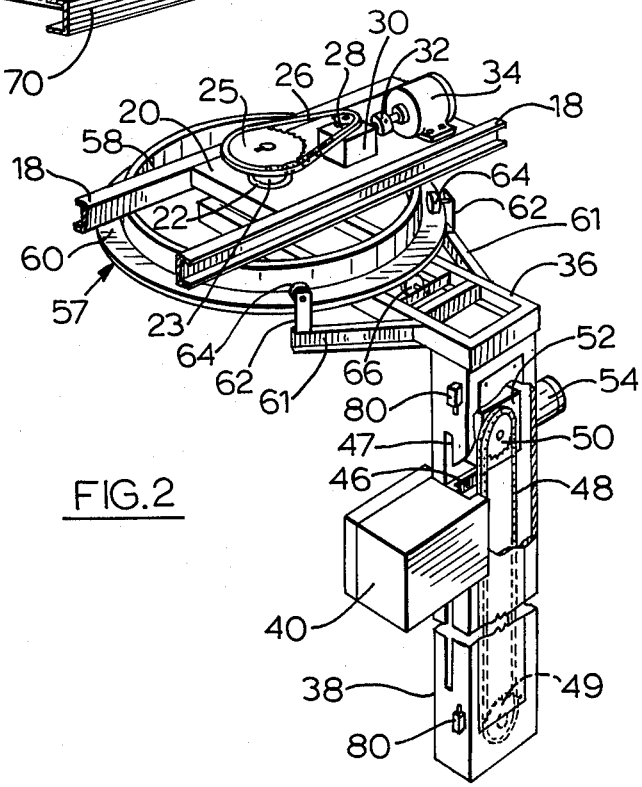
FIG.2

OVERHEAD LOAD-WRAPPING APPARATUS

This invention relates generally to apparatus for wrapping plastic film around a palletized load, and has to do particularly with an apparatus design which carries out the wrapping procedure on the overhead principle, in which the main motive portions are suspended above the palletized load, and the roll of film is caused to orbit around the load while the wrapping is under way.

There are a number of load-wrapping devices currently available in the market which are based on the principle of supporting a palletized load on a rotary table or platform, while film is paid out to enwrap the load from a roll of film which is supported on an adjacent vertical portion of the machine, the latter being stationary with respect to the floor. In cases where the width of the film is less than the height of the load, a carriage can be provided for raising and lowering the roll of film progressively as the wrapping proceeds, in order to enwrap the load in a helical fashion. In other cases, where the width of the film is at least as the height of the load, no vertical reciprocatory motion need be undergone.

Conventional devices of the kind just described suffer from several drawbacks. For one thing, the amount of energy required to start the rotation of a heavy load is considerable, and the structural strength of the members called upon to support the platform while in rotation entails a considerable expenditure. Additionally, the necessity for the adjacent vertical tower portion of the apparatus, in order to support the roll of film, occupies space which might have more economical uses, if freed. Finally, with conventional apparatus of the kind described above, it is necessary to use fork lift machines to raise and lower the palletized load with respect to the rotary platform, or with respect to a conveyor system on a level with the rotating platform. It would constitute a saving of time, man power and energy if an arrangement could be provided whereby a palletized load could be wrapped while resting directly on the floor rather than requiring to be raised.

In view of the foregoing characteristics of conventional apparatus, it is an aspect of the present invention to provide a load-wrapping apparatus in which all of the major drive apparatus is located overhead directly above the palletized load, in which the palletized load can be wrapped while sitting on the floor of a work area, in which rotary motion involves only the roll and its supporting elements, rather than the much heavier load itself, and in which economy of cost, assembly time and required man power for operation can be effected.

Accordingly, this invention provides an apparatus for wrapping a film around a palletized load, comprising:

a frame, support means for supporting the frame spaced vertically above a location adapted to receive the palletized load, vertical shaft means supported by the frame, and motive means for rotating the shaft means with respect to the frame, an arm secured to the shaft means and extending away therefrom substantially horizontally such that the arm and the shaft means rotate together, a member affixed to the arm and extending downwardly therefrom at a location spaced from the shaft means, and means connected to the said member for supporting a roll of film such that the film can pay out to enwrap the load as the rotating arm carries the roll around the load on a circular path.

One embodiment of this invention is illustrated in the accompanying drawings, in which like numerals denote like parts throughout the several views, and in which:

FIG. 1 is a perspective view, partly broken away, of an overhead load-wrapping apparatus constructed in accordance with this invention;

FIG. 2 is a partly broken away perspective view of the main operational components of the apparatus of FIG. 1; and FIG. 3 is a perspective view, to a smaller scale, showing the helical wrapping procedure with the roll undergoing rotary motion and orbiting about the load.

Turning first to FIG. 1, the apparatus illustrated generally at the numeral 10 is seen to include a substantially square frame 12 which is supported at a vertically raised location by virtue of support means which are constituted by four corner-located posts 14. In the embodiment illustrated, the posts 14 are constituted by steel members of L-shaped configuration, which at their bases are welded to square plates 16 to allow weight distribution against the floor of a working area, usually of concrete.

The precise structural framework and the various members, plates, beams and so forth located within the frame 12 are not fully illustrated in the drawings, as they do not play any part in this invention. The essential portions of this structure are illustrated in FIGS. 1 and 2, and will now be described.

In FIG. 2, two steel members 18 of C-shaped cross section are partly illustrated, the ends having been broken away. These members 18 extend approximately centrally across the frame 12 parallel to two sides of the frame 12, and at right angles to the other two sides.

Bridging between the two members 18 is a mounting plate 20 which supports a vertical cylindrical sleeve 22 through which extends a vertical shaft 23 more clearly seen in FIG. 1 than in FIG. 2. The shaft 23 is mounted to the frame members in such a way that it is supported against axial loads. This can be done by the provision of conventional flange type bearing arrangements adapted to resist axial and thrust loads, but the latter have not been illustrated because they are well known.

As seen in FIG. 2, a toothed sprocket 25 is keyed to the shaft 23, and the sprocket 25 is driven by a chain 26 which also engages a sprocket 28 on a shaft extending from a speed-reducing gear box 30 of which the other shaft is driven through a selectively releasable slip-clutch 32 by a motor 34. Thus, by virtue by the speed-reducing gear box 30 and the difference in size between the gear 25 and the sprocket 28, the speed of rotation of the shaft 23 can be made very slow, for example, of the order of 6–12 rpm.

An arm 36 constructed of suitable frame members as shown in FIG. 2 is secured to the shaft 23 and extends substantially horizontally away from the shaft 23 in a radial direction. The location of mounting of the arm 36 with respect to the shaft 23 is along a plane which is below the general position of the frame 12, so that rotation of the arm 36 will be unimpeded. Thus, so long as the threshold slip-torque is not exceeded, the arm 36 will rotate.

A vertical member 38 is secured to the arm 36 at the distal or outward end and extends downwardly therefrom as shown in FIGS. 1 and 2. A carriage 40 is adapted to reciprocate vertically along the member 38, and the latter contains drive means for positively raising the lowering the carriage 40 with respect to the member 38. The carriage 40 supports a downwardly extending mandrel 42 on which a roll of film 44 can be mounted.

The carriage 40 contains means (not shown) for controlling the braking force applied to the mandrel 42, which is used to resist pay-out of film from the roll 44, so that a tension can be applied to the film during the wrapping procedure. This braking force is intended to be adjustable, and will be capable of setting and adjustment electrically from a control panel mounted in one of the posts 14.

As seen in FIG. 2, the carriage is mounted on a horizontal member 46 which extends through a slot 47 in the member 38, and which is secured to one reach of an internal endless chain 48 which is entrained over two sprockets 49 and 50. The sprocket 49 is located at the lower end and is mounted for free rotation in a vertical plane, while the sprocket 50 is mounted at the upper end and is adapted to be positively driven from a gear box 52 having an input shaft (not shown) which is driven by a reversible, variable-speed electrical motor 54. Thus it can be seen that control of the speed and direction of the electrical motor 54 will automatically determine the direction and speed of motion of the carriage 40 in the vertical direction along the member 38.

The location of attachment between the arm 36 and the shaft 23 constitutes one point of support for the member 38 which carries the carriage 40. However because of the mass of the latter it is of advantage to provide a second point of support spaced from the shaft 23 in order to allow stability of the vertical orientation for the member 38 and in order to help support the weight thereof. For this purpose, there is provided a stationary ring 57 which is mounted to the underside of the frame 12 in a position concentric with the shaft 23. The ring 57 includes a vertical, cylindrical portion 58, and an outwardly extending, substantially horizontal flange 60. The arm 36 has affixed to it two lateral extensions 61, each of which carries an upstanding bracket 62 on which a roller 64 is mounted for free rotation about a substantially horizontal axis intersecting the axis of the shaft 23. The two rollers 64 are located to run upon and bear downwardly against the upper surface of the flange 60, in order to support the arm 36 against the downward pull exerted by the weight of the arm 36 itself as well as the member 38 and the portions which the latter supports.

As particularly seen in FIG. 2, in the embodiment illustrated the arm 36 also supports a further roller 66 which is positioned to bear against the flange 60 on its underside, and which is located midway between the rollers 64. This provides a three-point support for the arm 36 with respect to the flange 60, thus supporting the arm 36 against twisting torque during acceleration and deceleration of its rotary motion. Depending upon the weight and acceleration characteristics of the arm 36, it can become possible and even desirable to omit the underneath roller 66. The wide-stance support provided by the rollers 64 will provide sufficient steadiness in many cases.

In the embodiment shown, the wrapping apparatus is illustrated as straddling a conveyor 70 consisting of elongated rail members 72 and a plurality of driven or freely rotating rollers 73. A load 75 mounted on a conventional pallet 77 is pushed or driven by the roller system to a location substantially directly under the shaft 23, prior to the wrapping operation.

With a suitable roll of film 44 mounted on the mandrel 42 extending downwardly from the carriage 40, the leading end of the film is pulled off by the operator and attached to the load 75, for example by tucking it in between two stacked boxes or the like.

The operator then commences the wrapping operation by initiating rotation of the shaft 23, which carries the member 38 and the roll 44 in a circular path around the load 75. As the roll 44 is orbiting the load 75, with the latter stationary, the film from the roll will continuously pay out to enwrap the load. When utilizing film of which the width is less than the height of the load 75, the reciprocatory capability of the carriage 40 would be utilized, and the roll 44 would be caused to reciprocate upwardly and downwardly along the member 38 during the orbiting motion, thereby to enwrap the load 75 in the manner illustrated in FIG. 3.

While the load 75 is shown resting on the conveyor 70, it will be understood that the conveyor could be dispensed with, and the load 75 placed squarely on the floor of the work area within the apparatus.

In FIG. 2, limit switches 80 are shown at the top and bottom of the slot 47, arranged so as to be contacted by the carriage 40 at the extreme ends of its vertical travel. The signals from the limit switches are employed to cause reversal of the rotational direction of the motor 54, through appropriate electric circuitry that need not be illustrated as it is conventional and forms no part of this invention.

I claim:

1. An apparatus for wrapping a film around a palletized load, comprising:

a frame, support means for supporting the frame spaced vertically above a location adapted to receive the palletized load, vertical shaft means supported by the frame, and motive means for rotating the shaft means with respect to the frame, an arm secured to the shaft means and extending away therefrom substantially horizontally such that the arm and the shaft means rotate together, a member affixed to the arm and extending downwardly therefrom at a location spaced from the shaft means, means connected to the said member for supporting a roll of film such that the film can pay out to enwrap the load as the rotating arm carries the roll around the load on a circular path, and a stationary ring concentric with the shaft means and located above the arm, the ring being supported by the frame having a substantially horizontal flange, the arm including bracket means which supports at least one roller for free rotation about a substantially horizontal axis intersecting the axis of said shaft means, the roller running on the upper surface of said flange to support the arm against the downward pull exerted by the weight of the member.

2. The apparatus claimed in claim 1, in which the flange extends outwardly away from the shaft means, and in which said means for supporting a roll of film includes a carriage adapted to reciprocate vertically along the member, the latter having drive means for positively raising and lowering the carriage with respect to the member, the carriage supporting downwardly extending mandrel means on which the roll of film can be mounted.

3. The apparatus claimed in claim 1, in which there are two said rollers mounted for free rotation about substantially horizontal axes intersecting the axis of said shaft means, supported from two oppositely extending members projecting from the arm, the rollers being separated to provide a wide-stance support for the arm.

4. The apparatus claimed in claim 3, in which the arm also supports at least one further roller for free rotation about a substantially horizontal axis intersecting the axis of said shaft means, said further roller being positioned to bear against the flange on its underside at a location between the two first-mentioned rollers, thereby to support the arm against twisting torque during acceleration and deceleration of its rotary motion.

5. The apparatus claimed in claim 1, in which the motive means includes a slip-clutch which can slip in the event that the rotating portions come into contact with personnel, the load, vehicles and the like.

* * * * *